US008273974B1

(12) United States Patent
Gonzalez

(10) Patent No.: US 8,273,974 B1
(45) Date of Patent: Sep. 25, 2012

(54) FOLDING MECHANISM FOR BOLT-ON NECK STRINGED INSTRUMENTS

(75) Inventor: Eduardo Edison Gonzalez, North Miami Beach, FL (US)

(73) Assignee: Eduardo Edison Gonzalez, Miami, FL (US)

( * ) Notice: Subject to any disclaimer, the term of this patent is extended or adjusted under 35 U.S.C. 154(b) by 57 days.

(21) Appl. No.: 12/925,324

(22) Filed: Oct. 18, 2010

Related U.S. Application Data

(60) Provisional application No. 61/252,695, filed on Oct. 18, 2009.

(51) Int. Cl.
*G10D 3/00* (2006.01)

(52) U.S. Cl. ..... 84/293; 84/267; 84/291

(58) Field of Classification Search ..... 84/293, 84/267, 291
See application file for complete search history.

(56) References Cited

U.S. PATENT DOCUMENTS

| | | | | | |
|---|---|---|---|---|---|
| 277,925 | A | * | 5/1883 | Pfauntz | 16/366 |
| 350,693 | A | * | 10/1886 | Mustill | 84/269 |
| 2,367,528 | A | * | 1/1945 | Rollins | 280/603 |
| 3,831,485 | A | | 8/1974 | Dopera | |
| 3,910,151 | A | * | 10/1975 | Copeland | 84/267 |
| 4,073,211 | A | * | 2/1978 | Jorgensen | 84/291 |
| 4,111,093 | A | * | 9/1978 | Field et al. | 84/267 |
| 4,191,085 | A | | 3/1980 | Litwin | |
| 4,377,962 | A | | 3/1983 | Parker | |
| 4,638,708 | A | * | 1/1987 | Kamal | 84/293 |
| 4,686,882 | A | | 8/1987 | Shaw | |
| 4,770,079 | A | | 9/1988 | Mastroianni | |
| 5,058,479 | A | | 10/1991 | Shaw | |
| 5,233,896 | A | * | 8/1993 | Worthington et al. | 84/293 |
| 5,353,672 | A | * | 10/1994 | Stewart | 84/291 |
| 5,383,385 | A | * | 1/1995 | Gilbert | 84/267 |
| 5,390,578 | A | | 2/1995 | Raymer | |
| 5,442,986 | A | | 8/1995 | Cota | |
| 5,949,005 | A | * | 9/1999 | Peterson | 84/291 |
| 6,025,548 | A | | 2/2000 | Ehrlich | |

(Continued)

FOREIGN PATENT DOCUMENTS

GB 2428862 A * 2/2007

*Primary Examiner* — David Warren
*Assistant Examiner* — Robert W Horn

(57) ABSTRACT

This invention applies to a bolt-on neck guitar or similar instrument or device. The mechanism of this invention, a multiple section hinge with one end flap attached to the neck and the other end flap attached to the body while the center section stays sandwiched between the neck and the body in normal use, allows the removal of the neck screws with the strings under tension by the hinge absorbing the horizontal stress produced by the tension of the strings. The neck is then rotated 180 degrees to rest on top of the body where it can be secured with a clamp or a strap for transportation or stowage. The neck holding screws can be replaced with a large single one, reducing the time required to loosen the neck, while still maintaining the possibility of using the normal four screws in addition to or in lieu of the single one if so desired, since the tone of the guitar is improved when the pressure of the neck-body junction is increased and distributed over a larger area. By folding the neck on top of the guitar, the bulk and the chances of damaging the instrument are greatly reduced, since the neck can be secured at both ends and the instrument can fit in boxes or pieces of luggage in which an ordinary guitar would not fit, in particular a carry-on size piece of luggage, which allows the traveler guitarist to have full control of the whereabouts of the instrument at all times.

6 Claims, 3 Drawing Sheets

U.S. PATENT DOCUMENTS

| | | | | |
|---|---|---|---|---|
| 6,028,255 | A * | 2/2000 | Myronyk | 84/293 |
| 6,353,164 | B1 * | 3/2002 | Corsi | 84/293 |
| 7,365,254 | B2 * | 4/2008 | Johansson | 84/293 |
| 7,652,205 | B2 * | 1/2010 | Leach | 84/293 |
| 7,696,419 | B2 | 4/2010 | Chadwick | |
| 7,816,592 | B2 * | 10/2010 | Babicz | 84/293 |
| 7,902,442 | B2 * | 3/2011 | Leach | 84/293 |
| 2007/0056429 | A1 * | 3/2007 | Poschelk | 84/293 |
| 2007/0289427 | A1 * | 12/2007 | Liang | 84/291 |
| 2009/0151537 | A1 * | 6/2009 | Leach | 84/293 |

* cited by examiner

FOLDING MECHANISM FOR BOLT-ON NECK STRINGED INSTRUMENTS

CROSS-REFERENCE TO RELATED APPLICATIONS

This application claims the benefit of Provisional Patent Application Ser. No. 61/252,695 filed on Oct. 18, 2009 by the present inventor.

BACKGROUND

Previous Art

In the last few decades, the use of the electric guitar has spread to the point of giving it a privileged place among stringed instruments and making it a massive-phenomena. This trend is due to the versatility of the instrument, as well as to its portability and affordability, and was initiated by the development of the mass produced solid body guitars by Fender in the 50s, which was followed by a miriad of imitators locally and abroad, bringing down the cost and increasing the popularity of the instrument.

One of the main characteristics of the Fender guitars is the bolt-on neck which, although it does not improve the tone of the instrument in any known way, and probably came about as a necessity to reduce production cost, it has become a widely accepted standard, used in the vast majority of the solid body electric guitars being manufactured today Although an electric solid body guitar seems in itself quite transportable, there are many instances in which a traveler guitarist, even though he or she would like to have his or her instrument available for practice or other reasons, will rather leave the instrument behind than carry its bulk around. Most of the inconvenience of transporting a guitar comes from the length of the neck. Although in these guitars the neck is bolted on, it is not practical to remove it from the guitar for transportation, since it involves the removal or at least the loosening of the strings. The neck screws cannot be removed with the strings under tension, because these screws, besides pressuring the neck against the body, provide the horizontal force to counteract the tension of the strings, so removing them with the strings under tension would damage the threads in the neck. Removing or loosening the strings is a time consuming operation, which involves total re-tuning of the instrument.

Traveling with a guitar is a challenge because of the following reasons:

1—A regular guitar is about 40 inches (1 meter) long, which makes it a cumbersome load to carry and its motions hard to control.

2—There is always a risk of hitting an obstacle and damaging the guitar, specially the peghead, which is the most exposed part being at the tip of the neck.

3.—Transporting the guitar inside a hardshell case will diminish this risk, but at the expense of an increased bulk and weight.

4—Business travelers who enjoy playing a guitar in a different setting may prefer not to be seen carrying a guitar.

So there is a demand for a guitar whose bulk can be easily reduced to fit inside a carry-on size piece of luggage. Furthermore, a guitar whose size has been reduced has a clear advantage for stowage when the living space is limited.

Many solutions have been proposed and are available for guitars of reduced size and for guitars that can be reduced in bulk by either separating the neck from the body or by creating an articulation at the neck or at the junction of the body and neck to allow folding the instrument into a smaller size.

I have found that none of these proposed solutions satisfy all the needs of the traveling guitarist, either because they require extensive modifications to the basic guitar configuration, limit the quality of the playing experience by reducing the functionality of the guitar, and/or seriously affect the tonal qualities of the instrument. No foldable or portable guitar design prior to this invention fulfills all the needs of a traveling guitarist, which are:

1—Maintaining the integrity of the main components of the guitar: the body and the neck, so as to keep its sounding characteristics intact.

2—Having all the features that can be enjoyed on a regular guitar, namely:

- A full set of pickups to enable a complete range of tones.
- A full set of controls to further adjust the volume and tone.
- A regular tremolo bar.
- Full adjustability of critical parameters like intonation, action, and relief.
- Full size pickguard.
- A regular scale length, in the range of 24.5" to 25.5".

3—Making the folding/unfolding of the neck quick and easy and without removing or loosening the strings.

4—Having sufficiently reduced size as to fit inside an airline approved carry-on size piece of baggage.

5—Having a reduced total bulk such that other components of an electric guitar system (Amplifier, cables, accessories, laptop computer, etc) will also fit in a carry-on size case along with the guitar.

6—Having still enough size and weight to make playing comfortable and enjoyable.

7—Having an attractive appearance.

8—Use regular, single ball strings.

9—Being easy to manufacture, making the instrument affordable.

While some designs satisfy one or more of these ideal criteria for a travel guitar, I have found that none of the available designs known to me prior to this invention satisfies all of them at once.

SUMMARY OF THE INVENTION

The purpose of the present invention is to provide a simple, economical and quick neck folding mechanism for bolt-on neck guitars or similar instruments or devices which satisfies all the ideal criteria for the traveler user while conserving the integrity of the instrument, even offering the possibility of improving its tonal qualities because of the added mass and pressure at the neck to body joint.

This is achieved by linking the neck and the body of the guitar with a hinge having multiple sections, said hinge having one end flap affixed to the end of the neck and the opposite end flap affixed to the end of the body, and having one or more central sections that remain sandwiched between the neck and the body when the guitar is in use, without diminishing the qualities of the instrument in any significant way. Said hinge provides the mechanical attachment between the neck and the body which allows the removal of the holding screws with the strings under tension and the rotation if the neck by 180 degrees to come to rest face down on top of the body where it can be properly secured and protected.

The aforementioned hinge has the necessary holes to allow the holding screw or screws to cross it, and the plate from which it is manufactured can be sufficiently thin (0.040" or 1 mm) to remain between the neck and the body during normal use without affecting the guitar parameters, since it is possible to compensate the effect of this thickness with the standard adjustments of string action available in a regular guitar.

Also the neck, the body or both can be machined at the manufacturing stage (or if an existent guitar is being implemented with this solution) to take this thickness into consideration.

In one embodiment the disengagement of a single quick release handle screw frees the neck to be folded into the traveling or stowing position.

LIST OF THE PART NUMBERS

1—Body
1*a*—Pickguard
2—Neck
3—Strings
4—Fretboard
5*a* to 5*d* Neck screws (machine screws)
6—Body plate on the first embodiment
6*a*—Body plate on the second embodiment
7—Multiple flap hinge
7*a*—Neck end flap of the hinge
7*b*—Central section of the hinge on first embodiment
7*c*—First part of the central section of the hinge on the second embodiment
7*d*—Second part of the central section of the hinge on the second embodiment
7*e* Body end flap of the hinge
7*f*—Neck end flap pin
7*g*—Body end flap pin
7*h*—Central section pin
8—Neck end hinge screws
8*a*—Body end hinge screws
9—Thread inserts
10—Quick release cam handle screw
11—Neck holding plate on second and third embodiments
12—Neck plate screws
13—Bridge
14—Neck clamp
15—Thumb screw securing neck clamp
16—Padding material for fretboard protection
17—Nut
18—Top strings jacket leaf
19—Bottom strings jacket leaf
20—Top velcro strips
21—Bottom velcro strips
22—Double threaded piece
23—Securing nut

DESCRIPTION OF THE FIRST EMBODIMENT

Figure 1A:
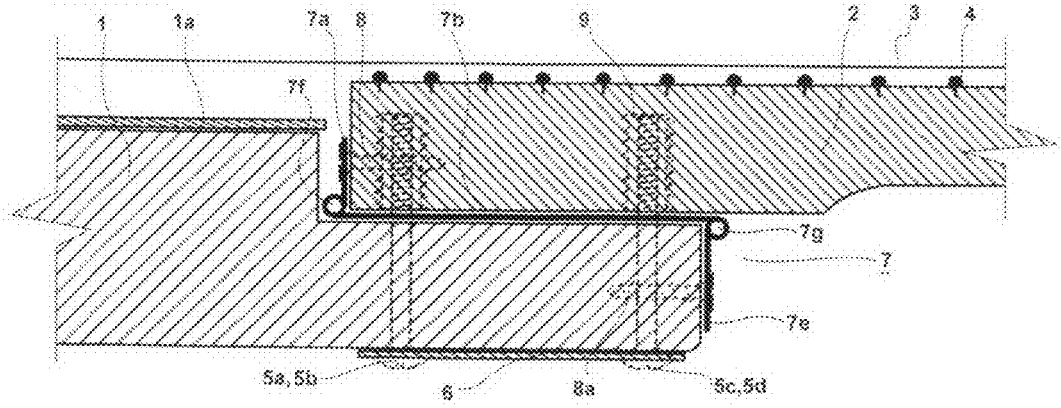
FIG. 1A is a cross section of the neck to body joint in the first embodiment in which a single central section is used, and the neck to body joint is secured with 4 machine screws threading into 4 thread inserts in sustitution to the wood screws normally used.
Figure 1B:
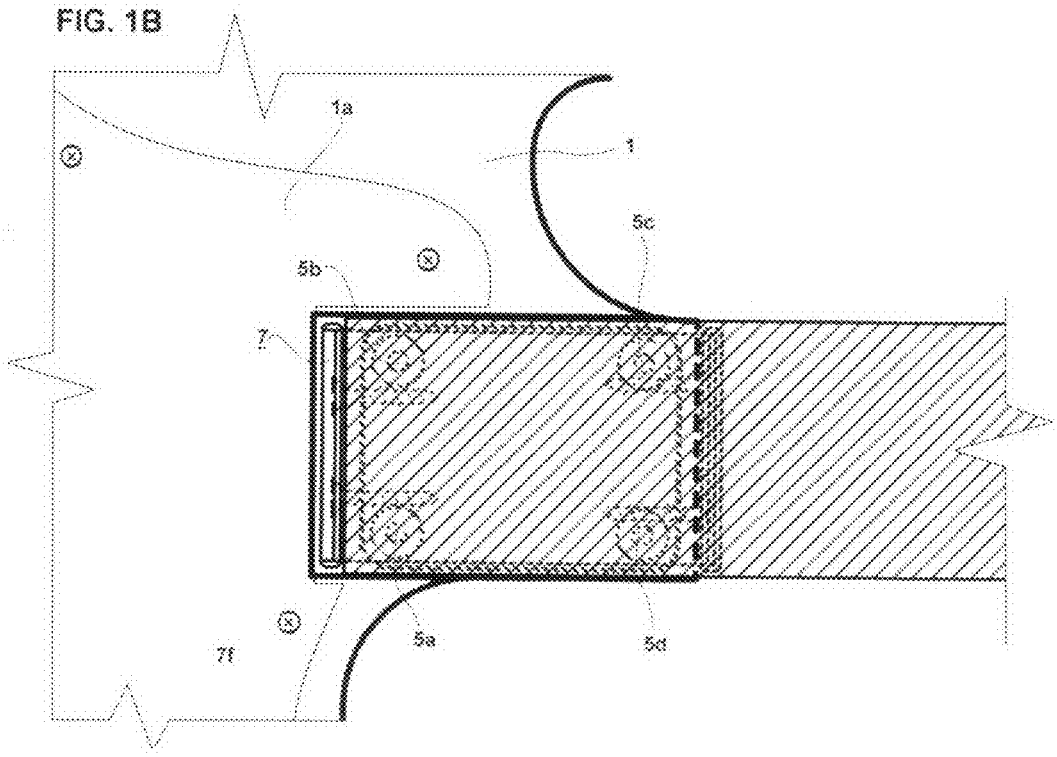
FIG. 1B is a cross section of the neck to body junction on the first embodiment as seen from the top.

When the guitar is in use section 7*b* of the hinge is sandwiched between the neck and the body as shown on FIG. 1A. Machine screws 5*a*, 5*b*, 5*c* and 5*d* thread into thread inserts 9 to secure the neck to the body as on a regular guitar with the added benefit of being able to provide more pressure than the wood screws that are normally used, which translates into better sustain and tone of the instrument, which is further enhanced by the added mass of the hinge.

Body plate 6 distributes the pressure applied by the screws 5*a* to 5*d* on the body, the same as on a regular guitar, except that it is glued to the body so that it will stay in its position when the screws 5*a* to 5*d* are removed.

The release of the neck is done with the strings under tension by unscrewing first the two neck screws close to the bridge 5*a* and 5*b*. Next, one and only one of the neck screws 5*c* or 5*d* is removed. The guitar is structurally stable with just one screw in place as long as it is one of the screws further away from the bridge, but it will not play well and it should not be handled in this condition for any purpose except for the removal of that last screw. For an easier removal of the last screw the guitar is rested face down on a soft surface like a bed or the seat of a sofa, or even on top of one's knees, and a counterpressure is applied with one hand on plate 6 near the head of the last screw to counteract the tension of the strings and prevent the collapse of the neck under the tension of the strings, so as to allow the removal of the last screw with as low stress as possible applied upon it.

The force required to prevent the collapse of the neck towards the bridge under the tension of the strings is rather low, and can be exerted with the tips of the fingers of one hand. This is because in this position the torque arm of the force exerted by the fingers is as long as the length of the guitar, while the torque exerted by the strings has a torque arm equal to the distance between the fulcrum point pin 7*f* and the strings 3, which is much smaller.

Once the last screw is removed the counterpressure is slowly released and the neck collapses towards the bridge. In practice such rotation is quite limited and the strings will relax when their length is shortened by just about ¼", so there is no sudden or violent collapse. The guitar is then turned face up, and the neck is free to rotate around pins 7*f* and 7*g* and adopt a resting position on top of the body.

Figure 3A:
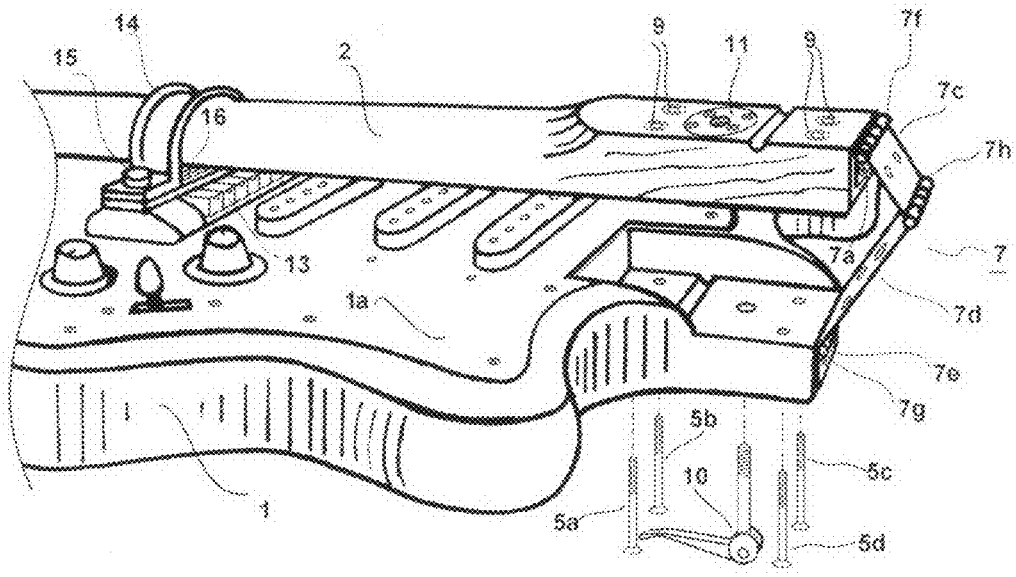
FIG. 3A is a perspective view of the third embodiment where the four screws of the first embodiment are used in addition to the central screw.
Figure 3B:
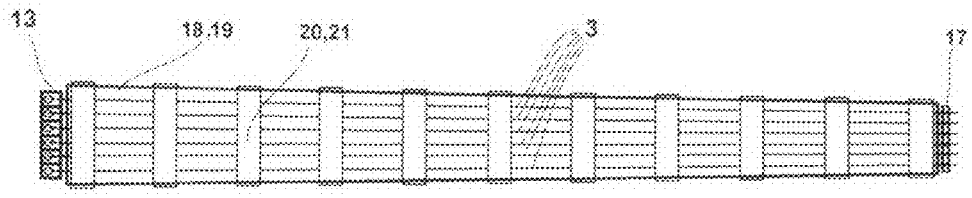
FIG. 3B is a top view of the strings protected inside the strings jacket where the two leaves of the jacket are made from transparent plastic film.

Before folding the neck the strings can be protected and help stay untangled by sandwiching them between the two leaves of flexible material that constitute the strings jacket depicted in FIG. 3B. Said jacket is slightly shorter than the scale length of the guitar and slightly wider than the footprint of the strings 3 in the playing position. The leaves 18 and 19 are provided with regularly spaced transversal fastening strips 20 and 21 made of complementary velcro fastener or a similar fastening material. One leaf is placed with the velcroed face up under the strings 3, and the other one is placed velcroed face down on top of the strings 3, allowing the joining of the strips of velcro fasteners 20 and 21 to imprision the strings and keep them aligned, protected and untangled.

A guitar capo placed on the first fret over the string jacket will further help in keeping the strings aligned and untangled. The use of a locking nut on the guitar can perform the same function.

The neck, resting on top of the body, is prevented from any horizontal movement which may damage the hinge by securing it with a clamp 14 made of (or jacketed with) a soft material to prevent scratching the surfaces, Said clamp can be secured to the tremolo arm's thread with a thumb screw 15 or by similar means. The clamp may include a thicker layer of soft padding material 16 to provide additional protection to the fretboard.

Returning the guitar to playing condition is the reversal of the operations in the same but reversed order. Given the ample excursion of the condition of the strings 3 during the folding/unfolding processes, the strings do not necessarily come back in tune, so some extent of retuning is necessary, but it does not differ too much from the regular retuning that any guitar will need after being transported on a trip.

This embodiment offers simplicity of the setup, minimal modifications to the guitar and an assemble/disassemble times and degree of difficulty which are acceptable for many users, but since the smallest possible angle between the neck 2 and flap 7*b* is 90 degrees when the neck is folded, the position of the neck on top of the body is limited to the perpendicular from the end of the neck's cavity on the body 1 (the position of flap 7*e*), which limits the extent to which the total length of the folded guitar can be reduced.

DESCRIPTION OF THE SECOND EMBODIMENT

Figure 2A:
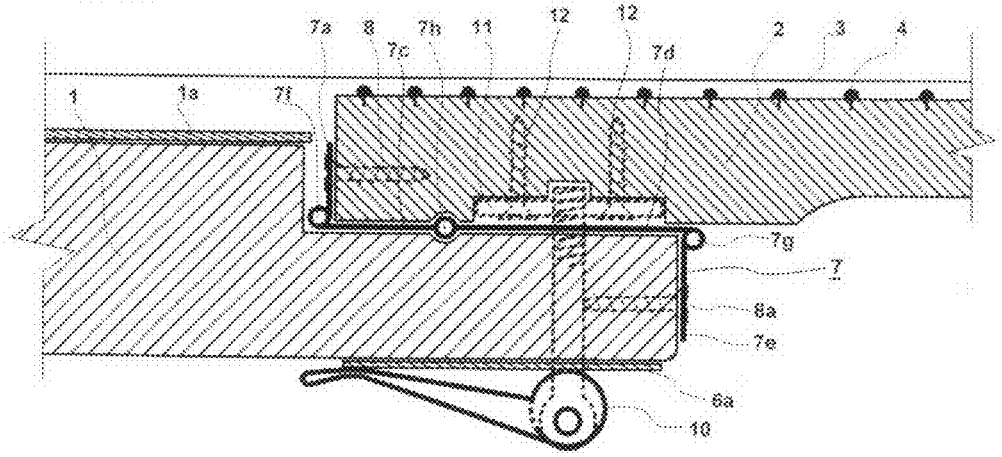
FIG. 2A is a cross section of the neck to body junction on the second embodiment where the central section has an additional pivoting point and a single quick release handle screw is used to secure the neck to body junction.
Figure 2B:
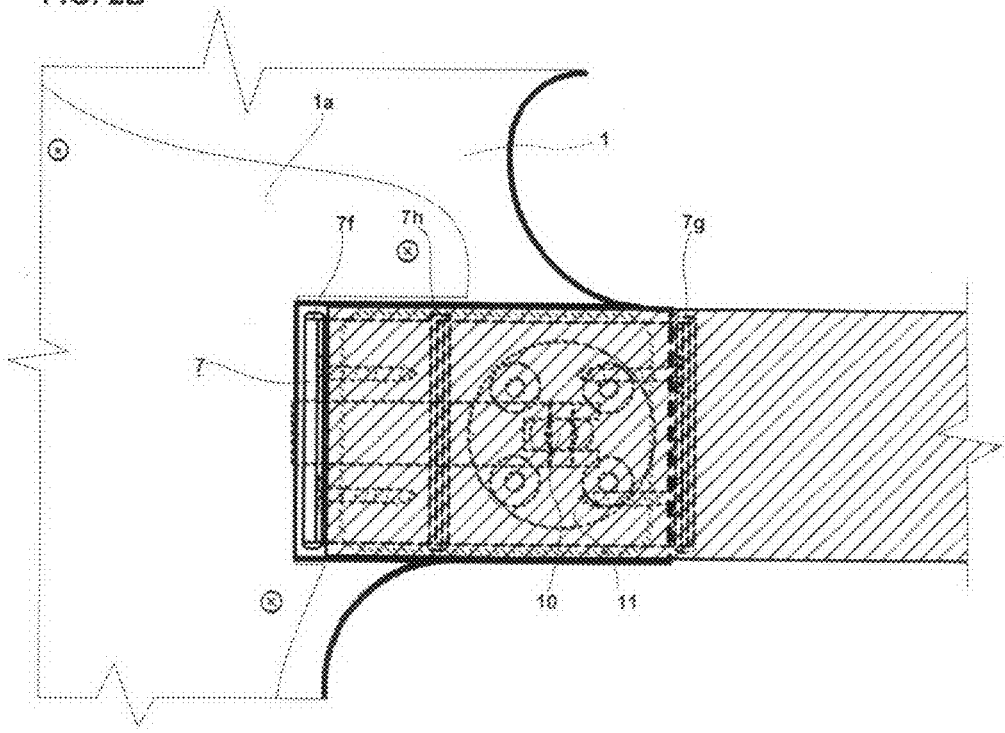
FIG. 2B is a cross section of the neck to body junction on the second embodiment as seen from the top.

FIG. 2A and FIG. 2B illustrate the second embodiment. The second embodiment differs from the first one in that the four machine screws 5*a* to 5*d* are replaced with a single, larger quick release handle screw 10 which threads into a plate 11 affixed to the bottom of the neck with screws 12, and in that the central flap 7*b* of the hinge is replaced by two flaps 7*c* and 7*d*.

Plate 6*a* plays a similar role as plate 6, distributing the pressure of the screw 10 over a larger area of the body.

Screws 12 affix plate 11 to the neck 2 and when the guitar is in use and transmit the tension on screw 10 from plate 11 to the neck 2, which converts it into pressure between the neck and the body in the area of contact surrounding plate 11.

Adding a third pivoting point at pin 7*h* gives better flexibility in the positioning of the neck when it rests on top of the body, allowing a displacement of the neck further away from the bridge to a position where the total length of the folded guitar can be minimized.

Compared to the first embodiment, replacing the four neck screws 5*a* to 5*d* with the single screw 10 allows for a faster release of the neck at the expense of a protrusion on the back of the guitar and a reduced body to neck contact area, which may adversely affect tone and sustain, so this embodiment will be favored by players that prefer quick assembly/disassembly procedures over quality of tone and smoothness of the back of the guitar's body. Also, the neck requires the carving of a cavity, for plate 11 and the neck and the body require the carving of a groove in the exact position to accommodate the articulation around pin 7*h*.

DESCRIPTION OF THE THIRD EMBODIMENT

FIG. 3A illustrates a third embodiment. The hinge has a divided center flap as in the second embodiment, and it allows the use of either a central screw as in the second embodiment, the four neck screws as in the first embodiment, or both.

The possibility of using both the single central screw 10 in addition to the four screws 5*a* to 5*d* means that in this embodiment the total pressure between neck 2 and body 1 can be much greater than on a regular guitar, giving an advantage in tone and sustain at the expense of a longer assemble/disassemble processes. In the end it represents the most flexible option, capable of meeting the highest number of requirements with the inconvenience of a somewhat higher production cost.

OTHER EMBODIMENTS

The specific embodiments of the invention that have been shown and described in detail in this description do not bar the possibility of other embodiments that will not depart from the principles of this invention.

For example, on the second embodiment the single screw 10 may have a different head shape, like socket head, button socket head, flat socket head, philips, hexagonal, slot, flat, be a thumbscrew, a wing bolt, etc., each of them having some possible advantage in terms of cost, replaceability, smoothness of the guitar's back surface, or other. A different type of quick release head can also be used, for example: a horizontally rotating collapsible handle with or without a cam.

The position of pins 7*f*, 7*g* and 7*h* relative to the plane of the flaps and central sections can be modified to obtain different configurations of the carvings on the body and neck that accommodate the joints of the hinge, and/or to modify the limiting angles between the sections of the hinge. For example, the joint at pin 7*g* can be oriented towards the body and fit on a cavity carved on it, with the effect of said joint becoming hidden from view.

Plates 6 or 6*a* can be affixed to the body using screws which may double as dowel pins crossing sections of hinge 7 to ensure the proper alignment of the neck with the body.

Plate 6*a* can have a concavity at the point where it is crossed by screw 10 to reduce its protruding height.

Also, although plate 11 is depicted as having a round shape (which makes easier to machine the cavity where it sits on neck 2) in actuality it can have any imaginable shape, including covering all the contact area between the neck and the body and using more screws to improve the strength of its linkage with the neck. Plate 11 can also have a welded or formed protrusion at the point where it is crossed by screw 10 to improve the strength and durability of the thread.

Figure 3C:
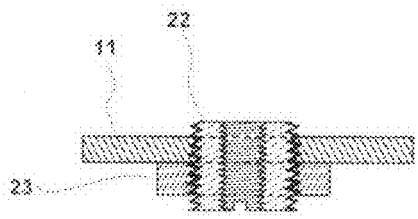
FIG. 3C is a variation on the neck's holding plate of the second and third embodiments.

Another possible variation of plate 11 is the addition of a double threaded piece 22 as shown on FIG. 3C, where the external thread allows its rotation to adjust the angular position of the internal thread engaging screw 10 in such a way as to allow the handle to be collapsed always with the same orientation, possibly into a cavity stamped on plate 6*a* and carved on body 1 in the playing position to reduce the protrusion of the handle. Rotating piece 22 and securing it by tightening nut 23 allows the adjusting of the tension on screw 10 to an optimal setting when the handle is at a fixed angular position with respect to the body 1.

In order to reduce the total weight and bulk, the size and shape of the body 1 can be reduced within limits that will not seriously affect the playability of the instrument.

A compact tuner system can be used in place of the peghead in order to reduce the total length of the neck and of the folded guitar.

The strings jacket of FIG. 3B can be made from a single piece of flexible material folded along at the middle rather than from two pieces, and the velcro or similar fastening material or compound can be applied over the whole surface rather than by strips.

All these and other modifications can be combined and applied to this invention without departing from its spirit and without invalidating its originality.

The foregoing is considered as illustrative only of the principles of the invention. Further, since numerous modifications and changes will readily occur to those skilled in the art, it is not desired to limit the invention to the exact construction and operation shown and described, due to the critical importance of such invention such invention has been conceived to improve the functionality of the electric guitar and accordingly all suitable modifications and equivalents may be resorted to, falling within the scope of the invention

What is claimed:

1. A neck to body joint mechanism for a bolt-on neck guitar or similar musical instrument or device comprising a hinge having three or more sections with one end flap affixed to the lower end of the neck and the opposite end flap affixed to the upper end of the body, its center section or sections staying sandwiched between the neck and the body when the instrument or device is in use, said hinge providing a mechanical link between the neck and the body capable of counteracting the pull of the strings, allowing the removal of the screw or screws joining the neck to the body without removing or loosening the strings of the instrument or device and, once the screw or screws are removed, allowing the neck to be rotated by about 180 degrees to be positioned face down on top of the body, pointing opposite to its normal position.

2. The neck to body joint mechanism of claim 1, where the neck is a bolt-on neck for electric guitar, and the center section or sections provides holes in the pattern for the neck joint, wherein the neck is secured to an electric guitar body by passing bolts through neck joint bolt holes, through the hinge center section or sections bolt holes and into bolt securing holes in the neck.

3. The neck to body joint mechanism of claim 2, where the hinge center section or sections comprises a single central plate hinged at each end, wherein a first end of the central plate is hinged to a first flap secured at the butt end of the neck and the second end is hinged to a second flap that is hinged to an area of the instrument body that is at a right angle to the neck joint area.

4. The neck to body joint mechanism of claim 2, where the hinge center section or sections comprises two central plates and a further intermediate hinge joint, the assembly hinged at each end, wherein a first end of the central plate assembly is hinged to a first flap secured at the butt end of the neck and the second end is hinged to a second flap that is hinged to an area of the instrument body that is at a right angle to the neck joint area.

5. The neck to body joint mechanism of claim 2, where the bolts of the bolt-on neck comprises a single quick release cam screw, the cam screw comprising, a shaft, threads on the shaft for attaching to the neck, an unthreaded length of shaft passing through the neck, a bolt head receiving a lever and a pivotable lever on the head comprising a cam surface, wherein the bolt loosens providing for a quick release when the lever is lifted and tightens when the lever is pivoted into contact with the instrument body, for quick reattachment of the neck.

6. The neck to body joint mechanism of claim 2, provided in assembly with a neck clamp that is securable to an electric guitar bridge, providing that the electric guitar neck can be released and folded by use of the hinge over upon the electric guitar body, and the neck secured in the vicinity of the guitar bridge in its folded position by the neck clamp.

* * * * *